US011959343B2

(12) United States Patent
von Gynz-Rekowski et al.

(10) Patent No.: US 11,959,343 B2
(45) Date of Patent: Apr. 16, 2024

(54) DRILLING SYSTEM WITH ANNULAR FLUSH SEPARATION DEVICE AND METHOD

(71) Applicant: Workover Solutions, Inc., Imperial, PA (US)

(72) Inventors: Gunther H H von Gynz-Rekowski, Montgomery, TX (US); Mark Allen Reeves, Houston, TX (US); Russell Wayne Koenig, Conroe, TX (US)

(73) Assignee: Workover Solutions, Inc., Imperial, PA (US)

( * ) Notice: Subject to any disclaimer, the term of this patent is extended or adjusted under 35 U.S.C. 154(b) by 0 days.

(21) Appl. No.: 17/942,316

(22) Filed: Sep. 12, 2022

(65) Prior Publication Data

US 2024/0084653 A1 Mar. 14, 2024

(51) Int. Cl.

| | |
|---|---|
| ***E21B 21/06*** | (2006.01) |
| ***E21B 21/00*** | (2006.01) |
| ***E21B 21/10*** | (2006.01) |
| *E21B 37/08* | (2006.01) |

(52) U.S. Cl.
CPC ..... *E21B 21/00* (2013.01); *E21B 21/103* (2013.01); *E21B 21/002* (2013.01); *E21B 21/10* (2013.01); *E21B 37/08* (2013.01)

(58) Field of Classification Search
CPC ..... E21B 21/002; E21B 37/08
See application file for complete search history.

(56) References Cited

U.S. PATENT DOCUMENTS

| | | | | |
|---|---|---|---|---|
| 6,223,906 | B1 | 5/2001 | Williams | |
| 7,243,740 | B2 * | 7/2007 | Frith | E21B 21/002 210/430 |
| 2004/0262044 | A1 * | 12/2004 | Schaaf | E21B 47/18 175/73 |
| 2007/0251729 | A1 * | 11/2007 | Sand | E21B 47/12 175/107 |
| 2011/0214963 | A1 | 9/2011 | Beylotte et al. | |
| 2013/0062261 | A1 | 3/2013 | Bailey | |
| 2020/0165908 | A1 | 5/2020 | Mahbes et al. | |

OTHER PUBLICATIONS

Drilling Tools International, Inc., Drill Pipe Mud Screens, 2022.
International Search Report and Written Opinion dated Oct. 11, 2023, from Applicant's counterpart International Patent Application No. PCT/US2023/25515.

* cited by examiner

*Primary Examiner* — Tara Schimpf
*Assistant Examiner* — Jennifer A Railey
(74) *Attorney, Agent, or Firm* — Jones Walker LLP

(57) ABSTRACT

A drilling system for use in drilling a wellbore including a driving mechanism and a separation device disposed upstream of the driving mechanism. The separation device filters at least a portion of any solids from drilling media flowing through a filter flow path of the separation device. The separation device flushes at least a portion of the filtered solids through a flush flow path, through a flush outlet on an outer surface of the separation device, and into an annulus between the outer surface of the separation device and the wellbore. Optionally, the drilling system includes a second driving mechanism and a second separation device disposed above the second driving mechanism.

29 Claims, 17 Drawing Sheets

DRILLING SYSTEM WITH ANNULAR FLUSH SEPARATION DEVICE AND METHOD

BACKGROUND

In the process of drilling and maintaining a wellbore, drilling fluid is pumped through drilling motors, such as positive displacement motors, and other drilling and completion equipment, such as friction reduction tools, percussion hammers, and turbines. Most drilling fluids contain solid particles (e.g., weighting material such as barite and hematite, low gravity solids such as bentonite clay, fractured rock and cuttings). Certain portions of the drilling and completion equipment are sensitive to the solid particles within the drilling fluid. For example, certain drilling motors include only metal components, which are not able to flex when drilling fluid containing solid particles flows between the components. Instead, the solid particles often become wedged between two metal components, which causes the drilling motors to prematurely wear out or to stop rotating, thereby disabling the metal-to-metal drilling motor. The power section of other drilling motors include elastomeric materials, which flex to enable solid particles to flow through the drilling motor. However, these elastomeric materials can begin to degrade or fail when the drilling motor is exposed to high temperatures within the wellbore or to oil-based drilling fluids with low aniline point.

In both cases, filters are sometimes positioned upstream of the drilling motors to reduce the amount of solid particles in the drilling fluid before the drilling fluid enters the drilling motors. However, the filters have limited capacity for the collected solid particles and fill after some time. Once the filter reaches capacity, some conventional filters direct the drilling fluid through pathways within the filter to bypass the solid particle capturing section of the filter and thereby retain any solid particles contained therein while allowing unfiltered drilling fluid to reach the downstream drilling motor.

FIGS. 1 and 2 illustrate one example of a conventional filter 2. Fluid flowing through filter 2 is directed to flow through filter surface 4 in order to collect solid particles within filter sleeve 6. When a predefined amount of solid particles are retained within filter sleeve 6, the associated pressure drop causes shear pin 8 to break and release filter sleeve 6, which moves downstream to open bypass ports 10 as shown in FIG. 2. In this position, fluid flow through filter 2 is allowed to continue when filter sleeve 6 is full of solid particles. However, the fluid flowing through the bypass ports 10 is unfiltered, increasing the likelihood of solid particles damaging the drilling motor downstream.

In order to clear the collected solid particles from the filter, conventional filters are usually pulled out from the drill string for cleaning. For example, filter 2 in FIGS. 1 and 2 is required to be pulled out from the drill string in order to remove the collected solid particles before fluid can be filtered again. Removing the filter from the wellbore requires the user to stop drilling operations and results in lost drilling time and increased drilling costs. Alternatively, the collected solid particles may be cleared from the filter by opening the solid particle collecting section of the filter to flush the collected solid particles downstream through a central fluid path with the flow of the drilling fluid to the drilling motor. Flushing the collected solid particles downstream with the drilling fluid results in an increased amount of solid particles flowing through the drilling motor, which increases the likelihood that solid particles will wedge between two metal components in a metal-to-metal drilling motor, thereby increasing the likelihood that certain drilling motors will prematurely wear or stop working altogether.

Accordingly, conventional filters and metal-to-metal drilling motors are not usually used in applications in which the drilling fluid contains solid particles. Instead, these tools are typically only used when the drilling fluid contains no solids, which is not favorable in most drilling applications. In applications involving solid particles in drilling fluid, drilling motors with elastomeric components are typically used. However, certain elastomer materials begin to break down at high temperatures, such as temperatures over 320° F., to which drilling tools are exposed within particular zones (i.e., high temperatures zones) of certain subterranean wellbores. In wellbores through high temperature zones, metal-to-metal drilling machines are the only option.

There is a need for a drilling system that filters solid particles from drilling fluid and clears the collected solid particles from the filter without removing the system or the filter from the wellbore and without releasing the collected solid particles through the drilling machine. There is a further need for a drilling system that enables the effective use of solid particles within drilling fluids, even when the drilling system is exposed to high temperatures.

BRIEF DESCRIPTION OF THE DRAWING VIEWS

DETAILED DESCRIPTION OF SELECTED EMBODIMENTS

Disclosed herein is a drilling system including a driving mechanism and a separation device that self-cleans by flushing collected solids into the annulus around the outer surface of the separation device. Neither the driving mechanism nor the separation device includes any high temperature sensitive materials.

FIGS. 3-29 illustrate multiple embodiments of the drilling system disclosed herein, with many other embodiments within the scope of the claims being readily apparent to skilled artisans after reviewing this disclosure.

Figure 1:
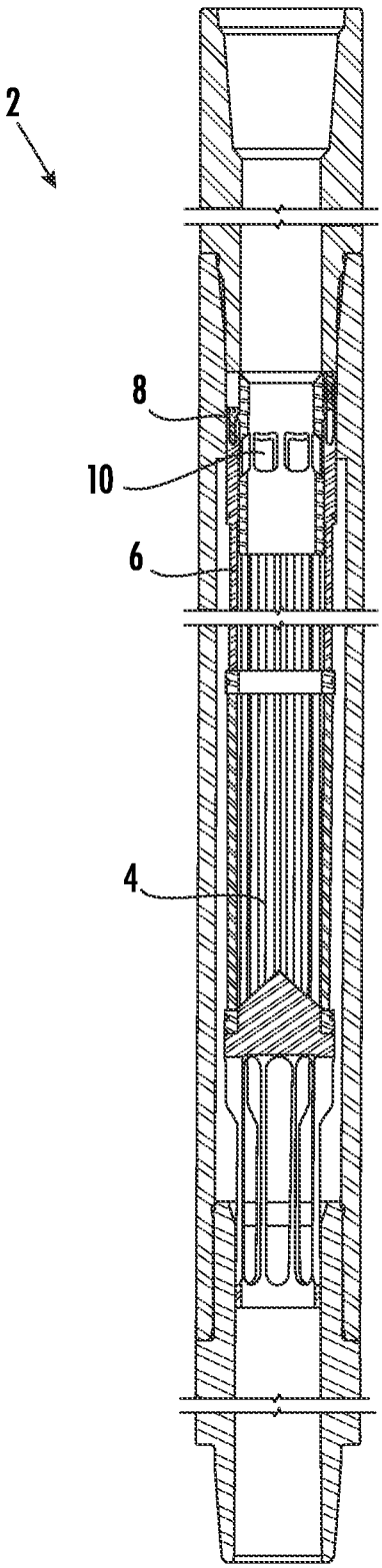
FIG. 1 (PRIOR ART)
FIG. 1 is a sectional view of a prior art filter device in a filtering position.
Figure 2:
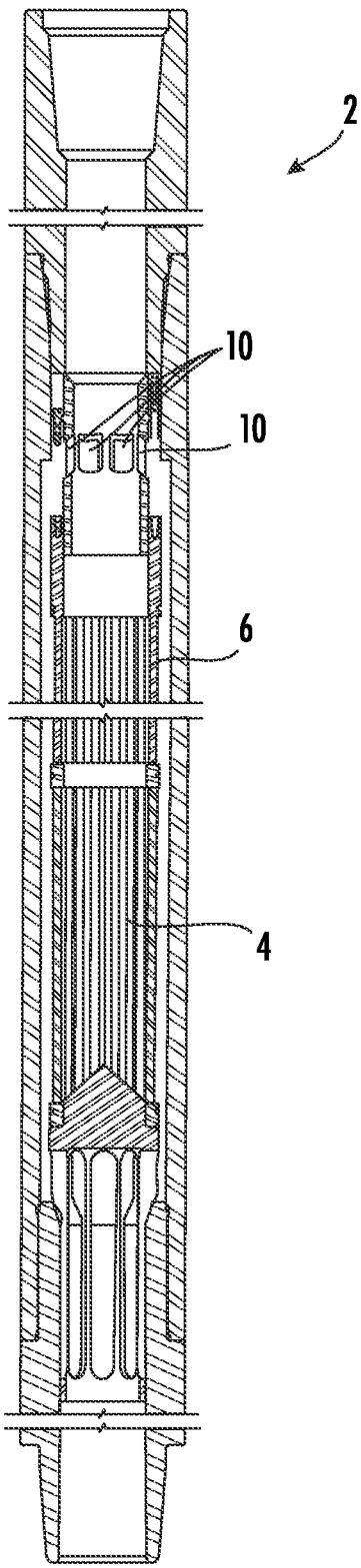
FIG. 2 (PRIOR ART)
FIG. 2 is a sectional view of the prior art filter device shown in FIG. 1 in a bypass position.
Figure 3:
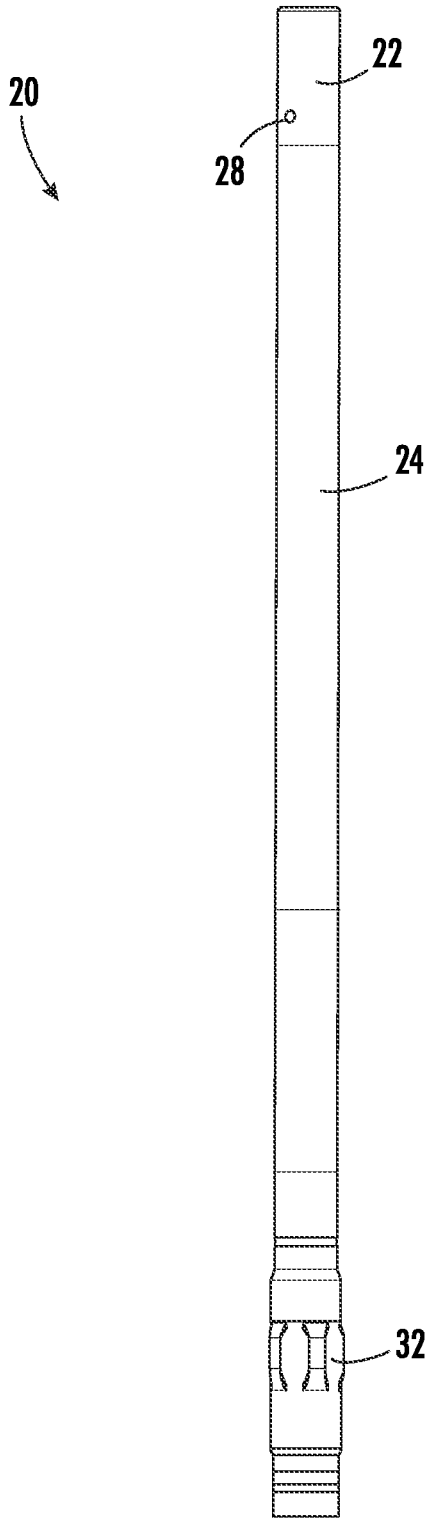
FIG. 3 is a front view of a drilling system of the present disclosure.

With reference to FIG. 3, drilling system 20 includes separation device 22 connected upstream of driving mechanism 24, which is connected upstream of a drill bit or mill. Driving mechanism 24 may include any device that converts hydraulic horsepower or pneumatic horsepower into mechanical horsepower, including, but not limited to, mechanical horsepower for use in driving a bit or mill, powering an electrical generator, activating a valve, activating any actuation device, or generating a vibration or impact. For example, drilling mechanism 24 may include a positive displacement motor (e.g., a vane motor, a Moyno motor), a turbine, a friction reduction tool, a percussion motor, a vibration generating tool, and an impact generating tool. Separation device 22 is configured to remove at least a portion of solid particles contained in a fluid flowing through separation device 22 before it reaches driving mechanism 24. Non-limiting examples of solid particles that may be contained in the fluid include cuttings (e.g., rock particles), weighting materials (e.g., barite), and scale from pipes. Separation device 22 is also configured to release collected solids through flush outlet 28 when activated. Optionally, drilling system 20 may also include steering mechanism 32 disposed downstream of driving mechanism 24.

In some embodiments, separation device 22 and driving mechanism 24 are both elastomer-free such that all components are configured to operate at temperatures above 320° F. In certain embodiments, the elastomer-free separation device and driving mechanism are configured to operate at temperatures between 320° F. and 1110° F., or any subrange therein. In some embodiments, all components of driving mechanism 24 are formed of one or more metal materials.

Figure 4:
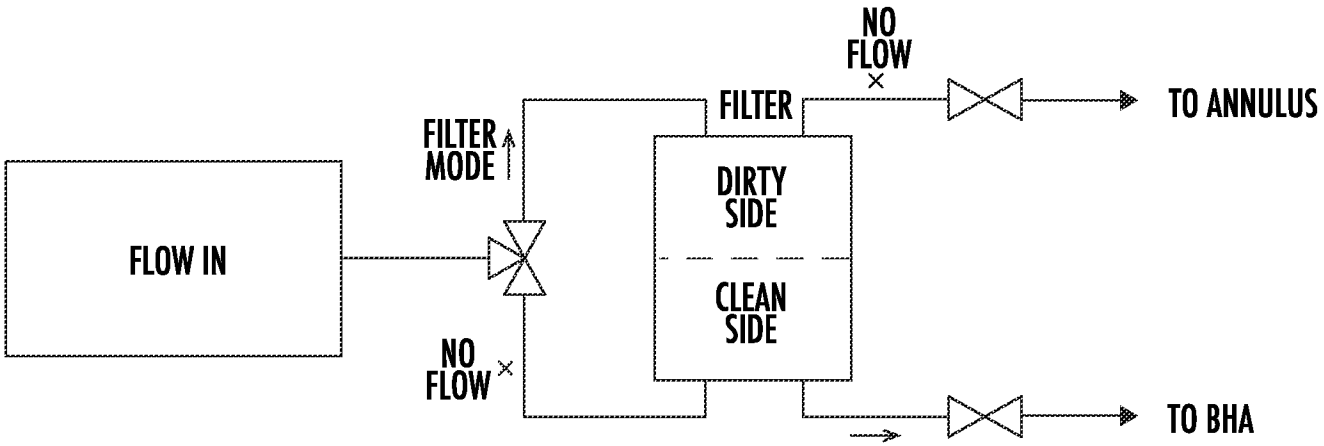
FIG. 4 is a schematic diagram of fluid flow through a separation device of the drilling system in a filter mode.

FIG. 4 illustrates the flow of fluid through separation device 22 in a filter mode. Fluid flowing into separation device 22 is directed to flow from the "dirty side" of the filter to the "clean side" of the filter. Filter media 34 retains solid particles on the "dirty side," while the fluid flows through filter media 34 to the "clean side." In the filter mode, the cleaned fluid is directed to the bottom hole assembly ("BHA") downstream, including driving mechanism 24.

Figure 5:
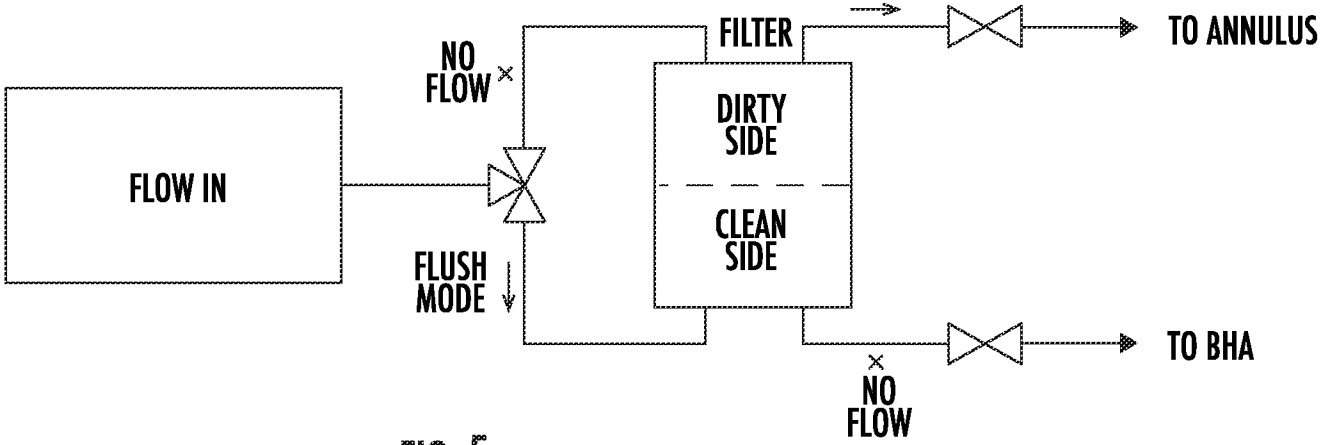
FIG. 5 is a schematic diagram of fluid flow through the separation device of the drilling system in an activated mode.

FIG. 5 illustrates fluid flow through separation device 22 in a flush mode. Fluid flowing into separation device 22 is directed to flow from the "clean side" of the filter to the "dirty side" of the filter. The fluid flushes some or all of the collected solid particles contained within separation device 22 through flush outlet 28 (shown in FIG. 3) and into an annulus surrounding an outer surface of separation device 22.

Figure 6:
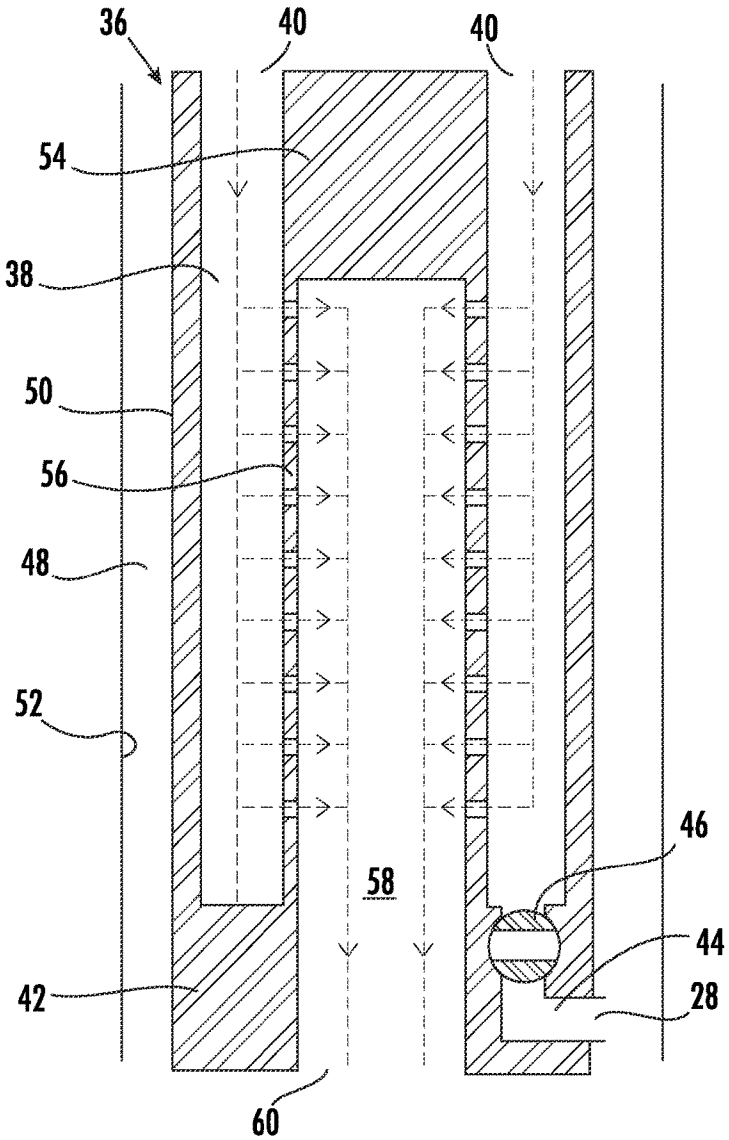
FIG. 6 is a sectional view of one embodiment of the separation device of the drilling system in the filter mode.

Referring to FIG. 6, separation device 22 may include filter 36. Filter 36 includes outer cavity 38 extending from fluid inlet 40 to base 42. The base 42 includes fluid port 44 and valve 46 configured to open and close fluid port 44. Fluid port 44 extends from outer cavity 38 to flush outlet 28, which is open to annulus 48 surrounding outer surface 50 of filter 36 and within a wellbore or casing 52. Filter 36 also includes central block 54 extending to filter surface 56 together forming the inner boundary of outer cavity 38. Openings in filter surface 56 extend from outer cavity 38 to central cavity 58, which extends from the space within filter surface 56 to fluid outlet 60. The arrows in FIG. 6 illustrate the flow path of fluid through filter 36 in the filter mode with valve 46 closed. Specifically, fluid enters filter 36 through fluid inlet 40 and flows through outer cavity 38, through openings in filter surface 56, through central cavity 58, and through fluid outlet 60. As fluid flows through the openings of filter surface 56, all or a portion of the solid particles contained within the fluid is retained in outer cavity 38. Over time, the solid particles collect within, and begin to fill, outer cavity 38. In some embodiments, separation device 22 is automatically activated in response to an automatic trigger (e.g., a pressure trigger). As used herein, "automatic activation" is independent from the surface. For example, valve 46 opens when a predefined fluid pressure increase upstream of filter surface 56 in response to the filling of outer cavity 38. In other embodiments, valve 46 is opened in response to a signal received from a surface of the wellbore. Such signals may be, but not limited to, a sequence of pressure pulses (mud weight changes), flow rate changes, drill pipe rotation changes or the use of RFID (Radio-frequency identification) technology.

Figure 7:
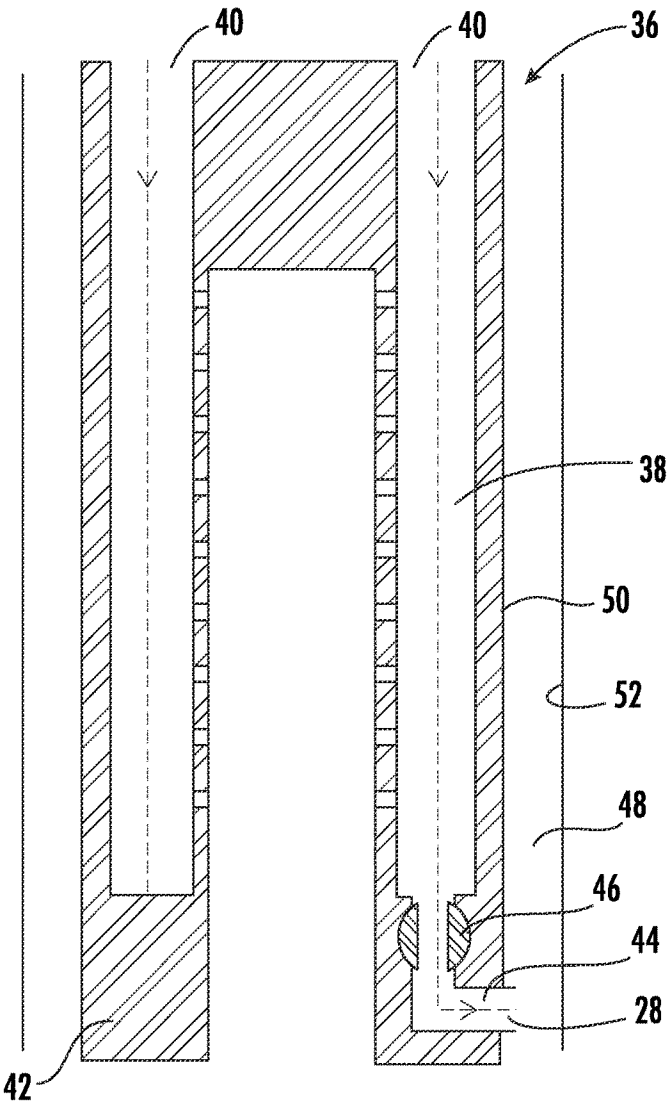
FIG. 7 is a sectional view of the separation device of FIG. 6 in the activated mode.

With reference to FIG. 7, opening valve 46 places filter 36 in the flush mode in which fluid communication is enabled between outer cavity 38 and fluid port 44. The arrows in FIG. 7 illustrate the flow path of fluid through filter 36 in the flush mode. Specifically, fluid flowing through outer cavity 38 is allowed to flow through fluid port 44 and exit through flush outlet 28, then flow into annulus 48. This fluid flow flushes the collected solids contained in the outer cavity 38 out of filter 36 and releases the collected solids through flush outlet 28 into annulus 48. Accordingly, filter 36 is not required to be removed from a wellbore for removing the collected solids nor does filter 36 release collected solids into the driving mechanism 24 or bottom hole assemblies downstream of separation device 22. Optionally, filter 36 may allow fluid flow through central cavity 58 and fluid outlet 60 in the flush mode.

Figure 8:
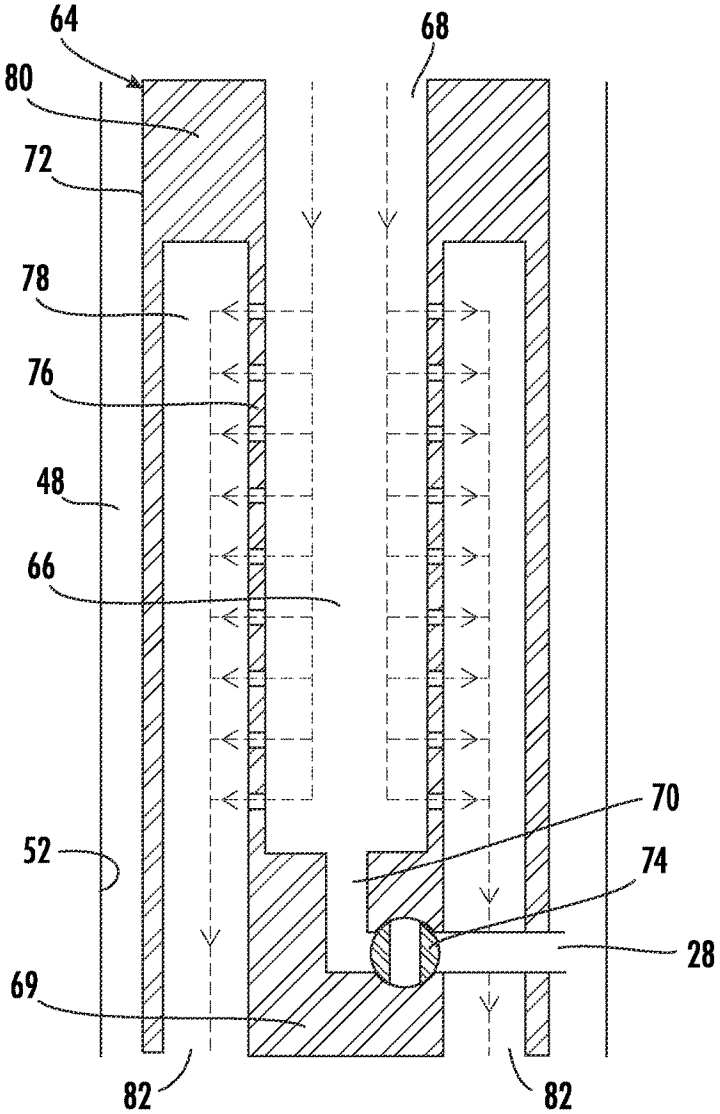
FIG. 8 is a sectional view of an alternate embodiment of the separation device of the drilling system in the filter mode.

Referring now to FIG. 8, separation device 22 may alternatively include filter 64. Filter 64 includes inner cavity 66 extending from fluid inlet 68 to central block 69 containing fluid port 70. Fluid port 70 leads to flush outlet 28, which is open to annulus 48 surrounding outer surface 72 of filter 64 and within a wellbore or casing 52. Valve 74 is configured to open and close fluid port 70. Filter surface 76 forms the outer boundary of inner cavity 66 and the inner boundary of outer cavity 78, which extends from upper block 80 to fluid outlet 82. Openings in filter surface 76 extend from inner cavity 66 to outer cavity 78. The arrows in FIG. 8 illustrate the flow path of fluid through filter 64 in the filter mode with valve 74 closed. Specifically, fluid enters filter 64 through fluid inlet 68 and flows through inner cavity 66, through openings in filter surface 76, through outer cavity 78, and through fluid outlet 82. As fluid flows through the openings of filter surface 76, all or a portion of the solid particles contained within the fluid is retained in inner cavity 66. Over time, the solid particles collect within, and begin to fill, inner cavity 66. In some embodiments, valve 74 is automatically opened in response to an automatic trigger. For example, valve 74 may open when a predefined fluid pressure increase is reached in response to the filling inner cavity 66. In other embodiments, valve 74 is opened in response to a signal received from a surface of the wellbore.

Figure 9:
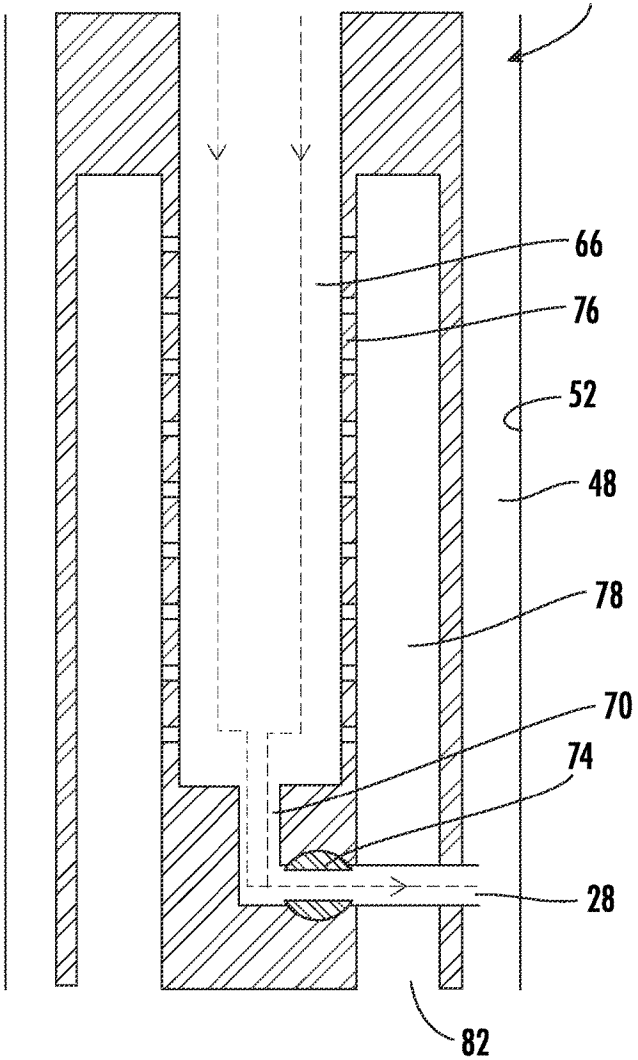
FIG. 9 is a sectional view of the separation device of FIG. 8 in the activated mode.

With reference to FIG. 9, opening valve 74 places filter 64 in the flush mode in which fluid communication is enabled between inner cavity 66 and fluid port 70. The arrows in FIG. 9 illustrate the flow path of fluid through filter 64 in the flush mode. Specifically, fluid flowing through inner cavity 66 is allowed to flow through fluid port 70, exit through flush outlet 28, and enter annulus 48. This fluid flow flushes the collected solids contained in the inner cavity 66 out of filter 64 and releases the collected solids through flush outlet 28 into annulus 48. Similar to filter 36, filter 64 is not required to be removed from a wellbore for removing the collected solids nor does filter 64 release collected solids into the driving mechanism 24 or bottom hole assemblies downstream of the separation device 22. Optionally, filter 64 may allow fluid flow through outer cavity 78 and fluid outlet 82 in the flush mode.

Figure 10:
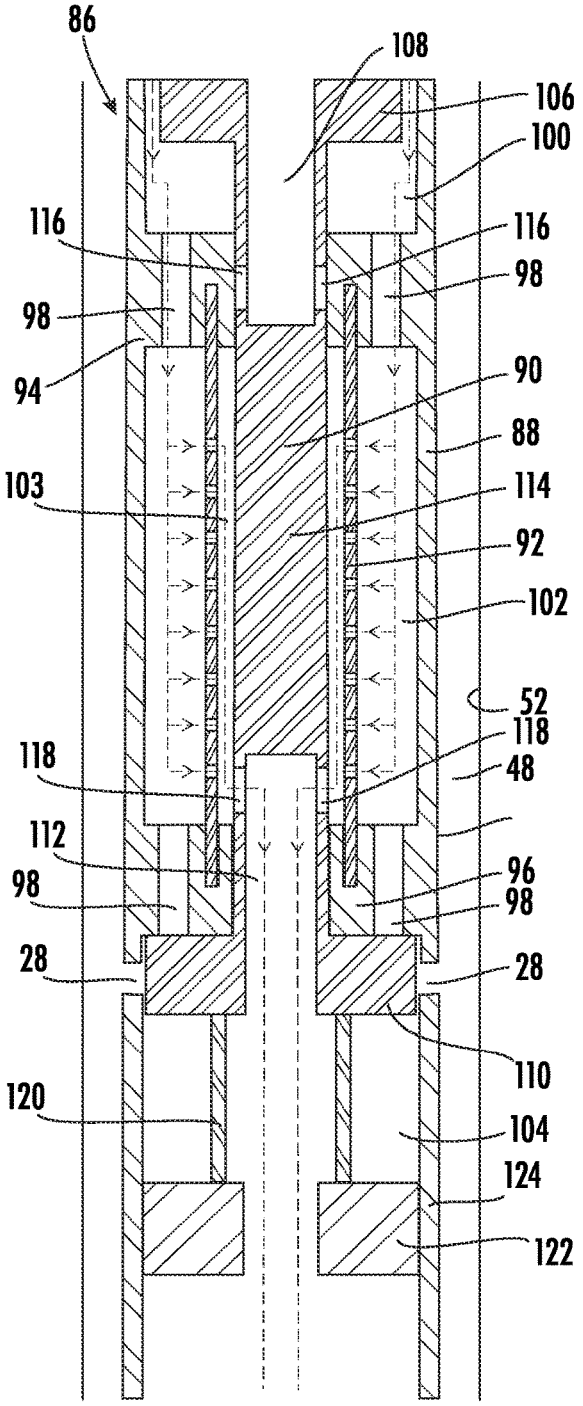
FIG. 10 is a sectional view of another alternate embodiment of the separation device of the drilling system in the filter mode.

Referring now to FIG. 10, separation device 22 may alternatively include filter 86. Filter 86 includes housing 88, piston 90 slidingly disposed within housing 88, and filter surface 92 disposed within housing 88 and concentrically surrounding piston 90. Housing 88 includes upper bridge 94 and lower bridge 96 extending across inner diameter. Upper and lower bridges 94 and 96 each includes a central bore configured to receive piston 90 and peripherally arranged fluid passages 98 parallel to the central bore. Housing 88 also includes inlet cavity 100 upstream of upper bridge 94, outer filter cavity 102 extending from upper bridge 94 to lower bridge 96 and surrounding filter surface 92, inner filter cavity 103 extending from upper bridge 94 to lower bridge 96 between piston 90 and filter surface 92, and outlet cavity 104 downstream of lower bridge 96. The openings in filter surface 92 fluidly connect inner filter cavity 103 and outer filter cavity 102. Housing 88 further includes flush outlets 28 from outlet cavity 104. Piston 90 includes upper block 106 surrounding a portion of piston inlet cavity 108, lower block 110 surrounding a portion of piston outlet cavity 112, and central block 114 extending between and separating piston inlet cavity 108 and piston outlet cavity 112. Upper and lower blocks 106 and 110 of piston 90 each have an extended diameter in relation to central block 114. Piston 90 includes upper ports 116 surrounding piston inlet cavity 108 and lower ports 118 surrounding piston outlet cavity 112. In the filter mode shown in FIG. 10, upper ports 116 are housed within the central bore of upper bridge 94 (i.e., upper ports 116 are "closed"), fluid passages 98 in upper bridge 94 fluidly connect inlet cavity 100 and filter outer cavity 102 (i.e., upper fluid passages 98 are "open"), lower ports 118 fluidly connect inner filter cavity 103 to piston outlet cavity 112 (i.e., lower ports 118 are "open"), and lower block 110 engages and blocks fluid passages 98 in lower bridge 96 and flush outlets 28 (i.e., lower fluid passages 98 and flush outlets are "closed"). Optionally, filter 86 may further include link 120 connecting control unit 122 to piston 90.

The arrows in FIG. 10 illustrate a filter flow path of fluid through filter 86 in the filter mode. Specifically, fluid enters filter 86 through inlet cavity 100, flows through fluid passages 98, through outer filter cavity 102, through the openings in filter surface 92, through inner filter cavity 103, lower ports 118 of piston 90, piston outlet cavity 112, and outlet cavity 104. As fluid flows through the openings of filter surface 92, all or a portion of the solid particles contained within the fluid is retained in outer filter cavity 102. Over time, the solid particles collect within, and begin to fill, outer filter cavity 102. In some embodiments, piston 90 automatically slides down in response to an automatic trigger. For example, piston 90 may slide in a downstream direction in response to a predefined fluid pressure or fluid pressure increase in response to the filling of outer filter cavity 102. In other embodiments, piston 90 slides in the downstream direction in response to a signal received from the wellbore surface, a signal received from control unit 122, or a combination thereof.

Figure 11:
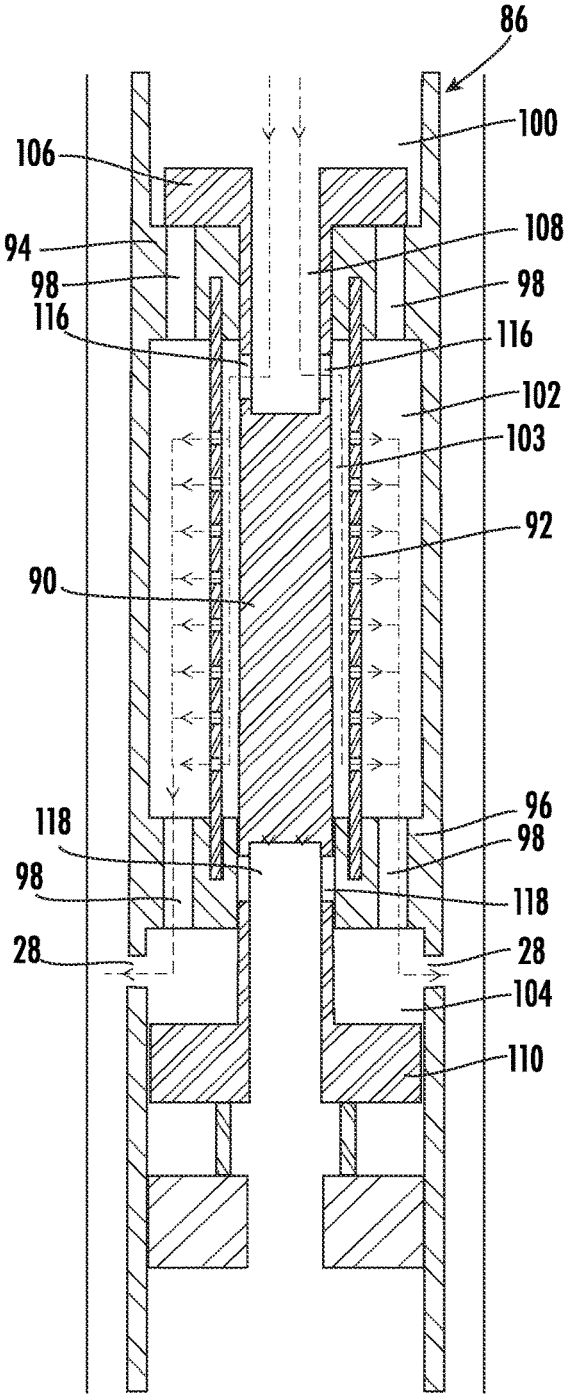
FIG. 11 is a sectional view of the separation device of FIG. 10 in the activated mode.

With reference to FIG. 11, the downstream movement of piston 90 into the flush mode may close all open ports and open all closed ports within filter 86: upper block 106 engages and blocks upper fluid passages 98 in upper bridge 94 (i.e., closes upper fluid passages), opens upper ports 116 of piston 90, closes lower ports 118 of piston 90 by positioning lower ports 118 within the central bore of lower bridge 96, opens lower fluid passages 98 in lower block 110, and opens flush outlet 28. The arrows in FIG. 11 illustrate a flush flow path of fluid through filter 86 in the flush mode. Specifically, fluid entering filter 86 through inlet cavity 100 flows through piston inlet cavity 108, upper ports 116, inner filter cavity 103, the openings in filter surface 92, through outer filter cavity 102, fluid passages 98 in lower bridge 96, outlet cavity 104, and filter ports 28, and then flow into annulus 48 between outer surface 124 of housing 88 and wellbore or casing 52. This fluid flow flushes the collected solids contained in the outer filter cavity 102 with the fluid flow through lower fluid passages 98 and out of filter 86 through flush outlets 28 into annulus 48. Accordingly, filter 86 is not required to be removed from a wellbore for removing the collected solids nor does filter 86 release collected solids into the driving mechanism 24 downstream of separation device 22. The discharge of collected solids into the annulus 48 enables drilling system 20 to use a driving mechanism 24 that does not include any high temperature sensitive materials, such as all metal components.

Figure 12:
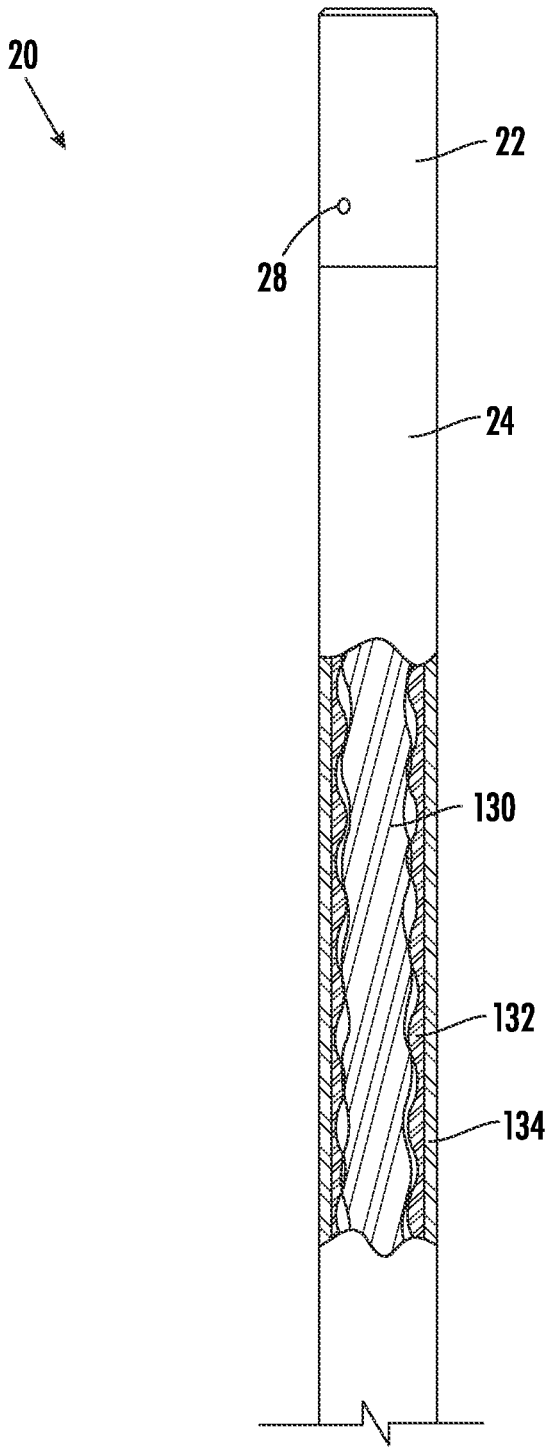
FIG. 12 is a partial cut-away view of an embodiment of the drilling system in which a driving mechanism includes a Moyno motor with a metal stator contour.
Figure 13:
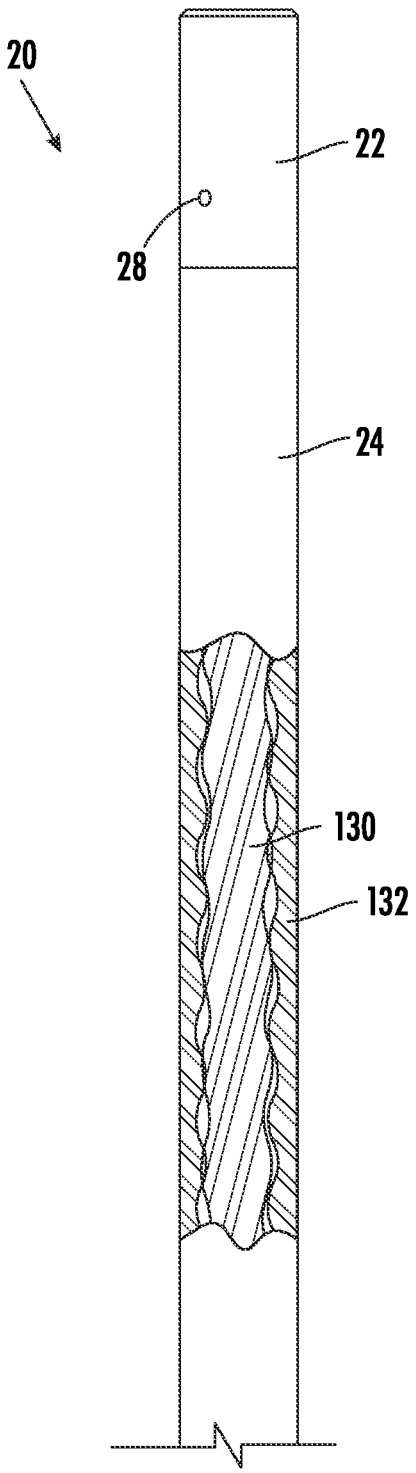
FIG. 13 is a partial cut-away view of an embodiment of the drilling system in which a driving mechanism includes a Moyno motor with a metal stator contour integrally formed with a stator housing.

Referring now to FIG. 12, the driving mechanism 24 of drilling system 20 may include a positive displacement motor having rotor 130 disposed within stator contour 132, which is secured within stator housing 134. Rotor 130, stator contour 132, and stator housing 134 may all be formed of one or more metal materials. For example, the rotor 130, stator contour 132, and stator housing 134 may form a Moyno motor. In a further embodiment illustrated in FIG. 13, the positive displacement motor includes rotor 130 disposed within stator 136, which includes a stator contour integrally formed with a stator housing. In other embodiments, the driving mechanism 24 of drilling system 20 may include any other positive displacement motor, such as a vane motor, a screw motor, a gear motor, or a lobe or roots motor. In certain embodiments the positive displacement motor of driving mechanism 24 is elastomer-free.

Figure 15:
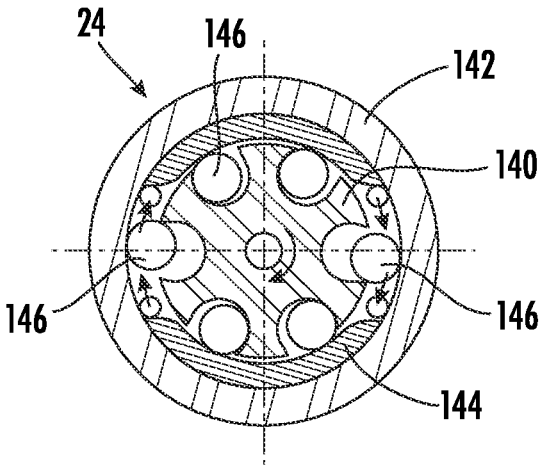
FIG. 15 is a sectional view taken from line 15-15 in FIG. 14.
Figure 14:
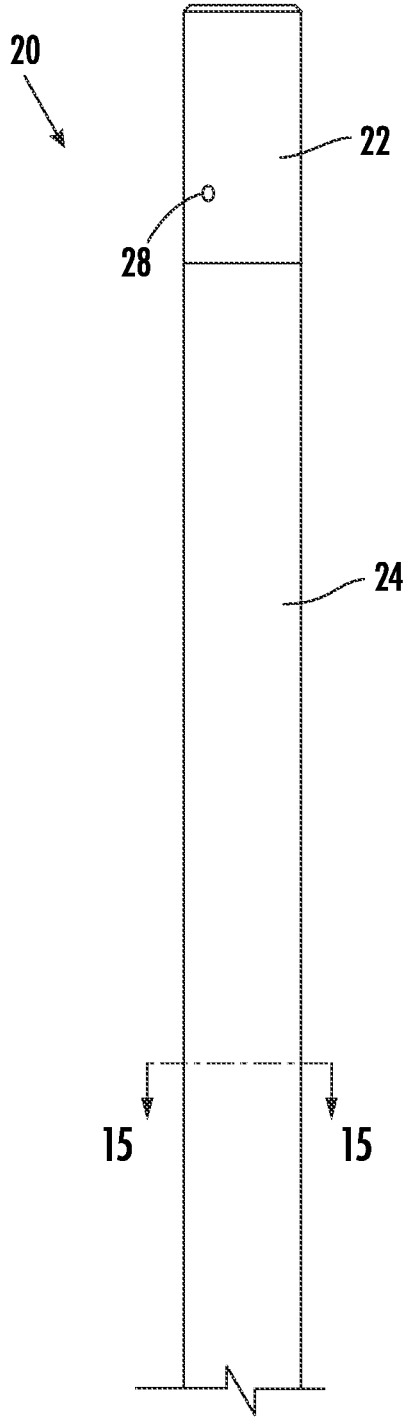
FIG. 14 is a partial front view of an embodiment of the drilling system in which a driving mechanism includes a vane motor.

With reference to FIGS. 14 and 15, the driving mechanism 24 of drilling system 20 may include an elastomer-free positive displacement motor. The positive displacement motor may be a vane motor having rotor 140 disposed within stator housing 142 and within stator contour 144, along with rollers 146 sized to fit into cavities in the outer surface of rotor 140. For example, rotor 140, stator housing 142, stator contour 144, and roller 146 may form a vane motor. In the filter mode, at least a portion of any solids contained in a drilling media flowing through separation device 22 are filtered out such that the drilling media contains a smaller amount or volume of solids and smaller sized solids when the drilling media flows through the space between rotor 140 and stator contour 144 and stator housing 142 in the vane motor. In certain embodiments, this positive displacement motor is elastomer-free.

Figure 17:
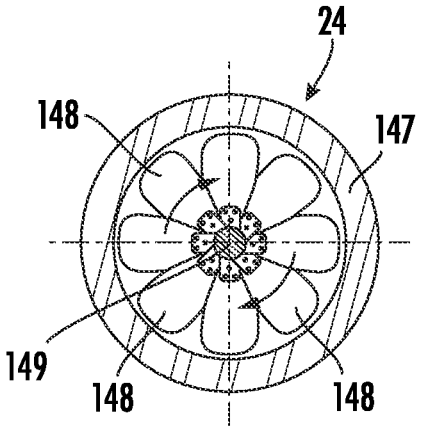
FIG. 17 is a sectional view taken from line 17-17 in FIG. 16.
Figure 16:
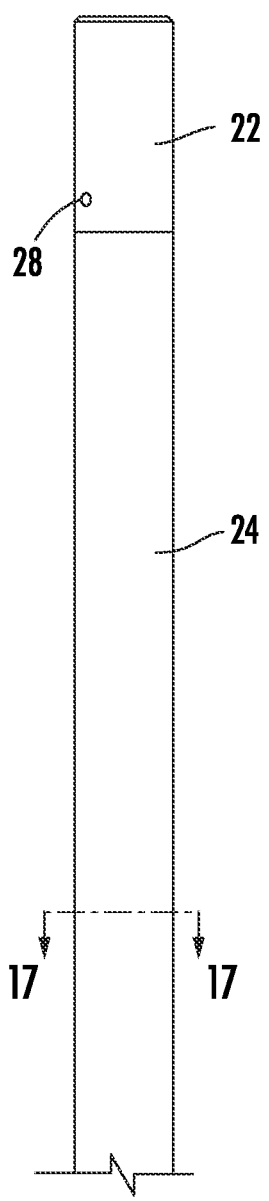
FIG. 16 is a partial front view of an embodiment of the drilling system in which a driving mechanism includes a turbine motor.

FIGS. 16 and 17 illustrate an embodiment of drilling system 20 in which the driving mechanism 24 includes a turbine motor. The turbine motor may include a housing 147 containing a plurality of rotor blades 148 distributed around central axis 149. Rotor blades 148 are configured to rotate in order to rotate central axis 149 in the direction of the arrows in FIG. 17. The turbine motor uses drilling media flowing through the tool to rotate central axis 149 (i.e., converting hydraulic horsepower or pneumatic horsepower into mechanical horsepower). In the filter mode, at least a portion of any solids contained in a drilling media flowing through separation device 22 are filtered out such that the drilling media contains a smaller amount or volume of solids and smaller sized solids when the drilling media flows through the space between rotor blades 148 and housing 147 in the turbine motor, thus reducing the risk of damage or failure of the turbine motor.

Figure 18:
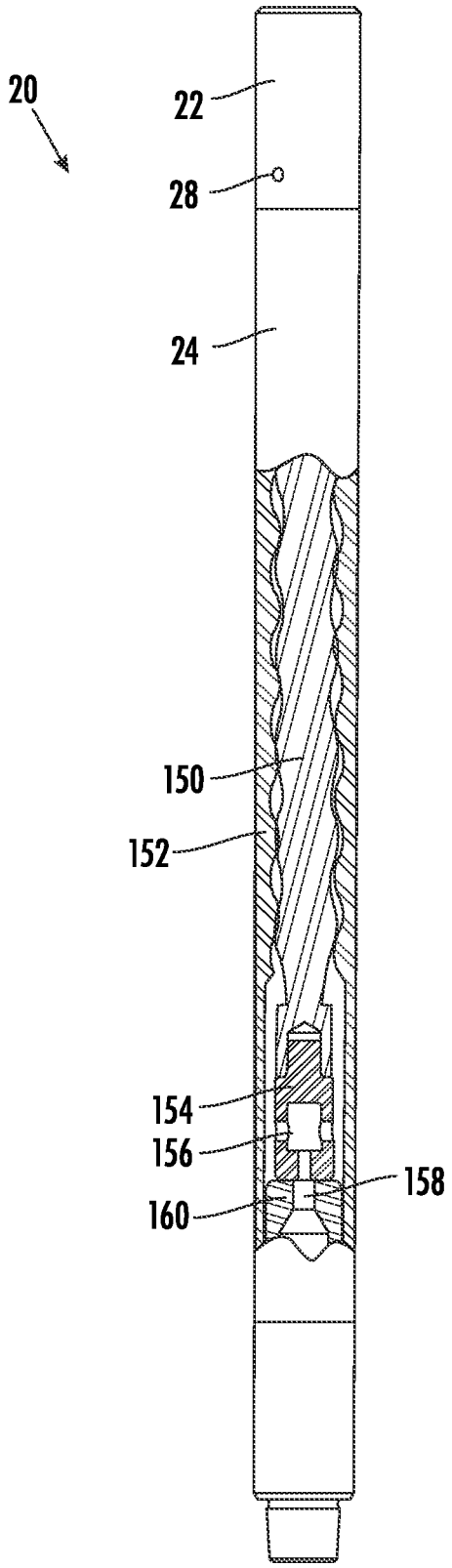
FIG. 18 is a partial cut-away view of an embodiment of the drilling system in which a driving mechanism includes a friction reduction tool in an open valve position.
Figure 19:
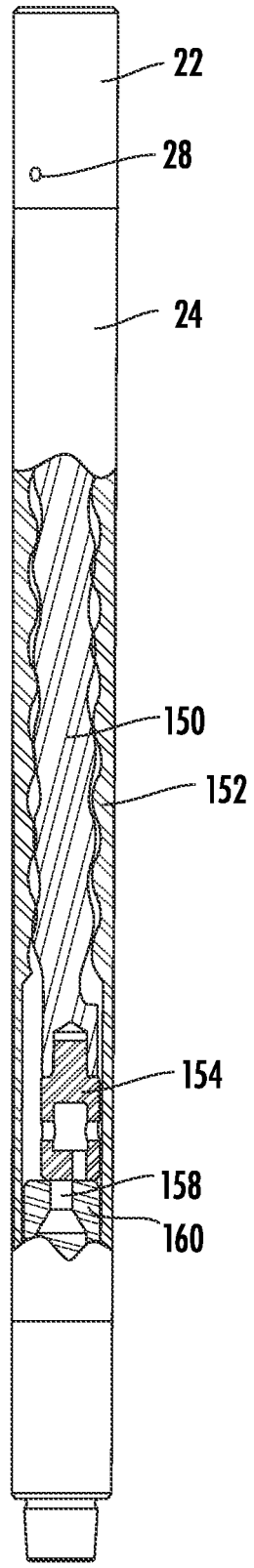
FIG. 19 is a partial cut-away view of the embodiment of the drilling system shown in FIG. 18 with the friction reduction tool in a closed valve position.

FIGS. 18 and 19 illustrate an embodiment of drilling system 20 in which the driving mechanism 24 includes a friction reduction tool. The friction reduction tool may include rotor 150 disposed within stator 152. Valve 154 may be secured to a downstream end of the rotor 150. Valve 154 includes flow path 156, which is open to flow path 158 in stationary valve 160 in the open valve position shown in FIG. 18. Flow path 156 is closed in the closed valve position shown in FIG. 19. In the closed valve position, drilling media is blocked from flowing to flow path 158 of stationary valve 160. In other words, the friction reduction tool uses drilling media flowing through the tool to rotate rotor 150 (i.e., converting hydraulic horsepower or pneumatic horsepower into mechanical horsepower), which transitions valve 154 between the open valve position and the closed valve position. In the filter mode, at least a portion of any solids contained in a drilling media flowing through separation device 22 are filtered out such that the drilling media contains a smaller amount or volume of solids and smaller sized solids when the drilling media flows through between rotor 150 and stator 152 in the friction reduction tool, thus reducing the risk of damage or failure of the friction reduction tool.

Figure 20:
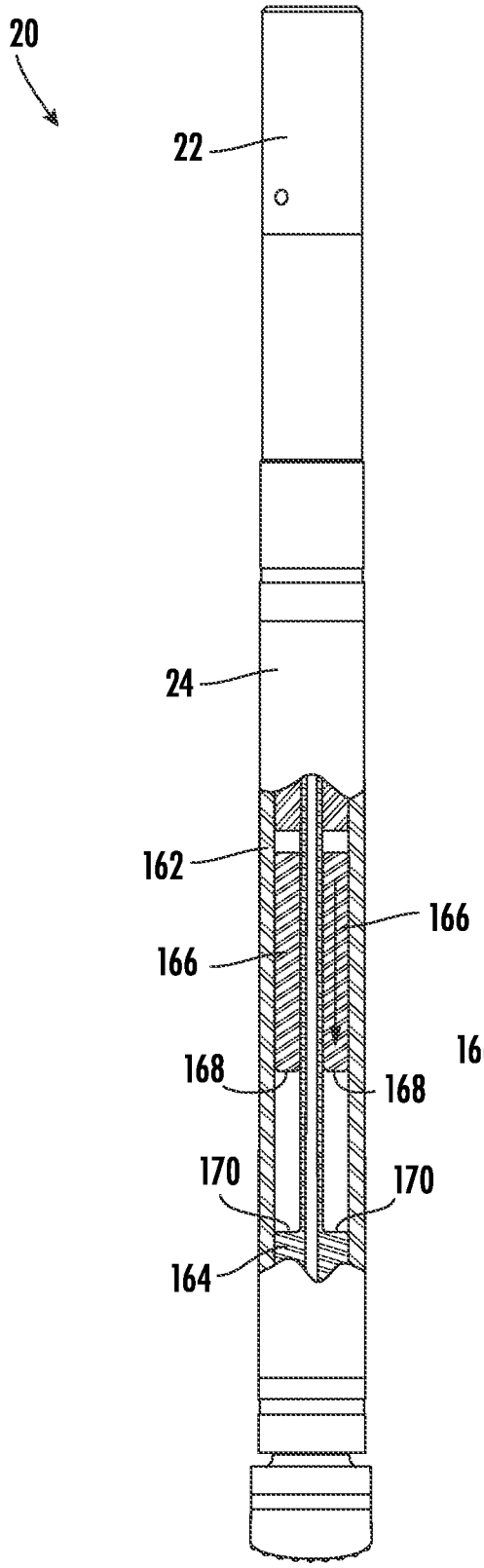
FIG. 20 is a partial cut-away view of an embodiment of the drilling system in which a driving mechanism includes a hammer device in a first position.
Figure 21:
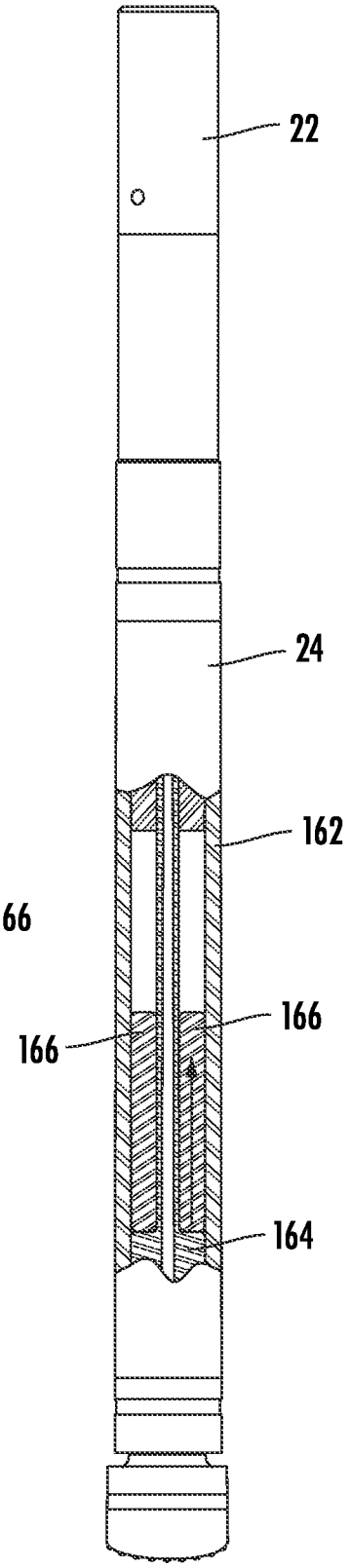
FIG. 21 is a partial cut-away view of the embodiment of the drilling system shown in FIG. 20 with the hammer device in a second position.

FIGS. 20 and 21 illustrate an embodiment of drilling system 20 in which the driving mechanism 24 includes a hammer device. The hammer device may include housing 162 containing mandrel 164 and one or more pistons 166 slidingly disposed in an annular space between mandrel 164 and housing 162. A downstream surface of each piston 166 may serve as a hammer surface 168 and an upstream facing shoulder of mandrel 164 may serve as an anvil surface 170. The hammer device uses drilling media flowing therethrough to slide pistons 166 in a downstream direction (i.e., converting hydraulic horsepower or pneumatic horsepower into mechanical horsepower) until the hammer surface 168 of each piston 166 generates an impact upon striking anvil surface 170 of mandrel 164. In the filter mode, at least a portion of any solids contained in a drilling media flowing through separation device 22 are filtered out such that the drilling media contains a smaller amount or volume of solids and smaller sized solids when the drilling media flows through the hammer device, thus reducing the risk of damage or failure of the turbine motor.

In each of these embodiments, driving mechanism 24 does not need to include any elastomer components or any other high temperature sensitive materials, which enables driving mechanism 24 to operate in temperatures above 320° F. In certain embodiments, driving mechanism 24 is configured to operate at temperatures between 320° F. and 1110° F., or any subrange therein.

Figure 22:
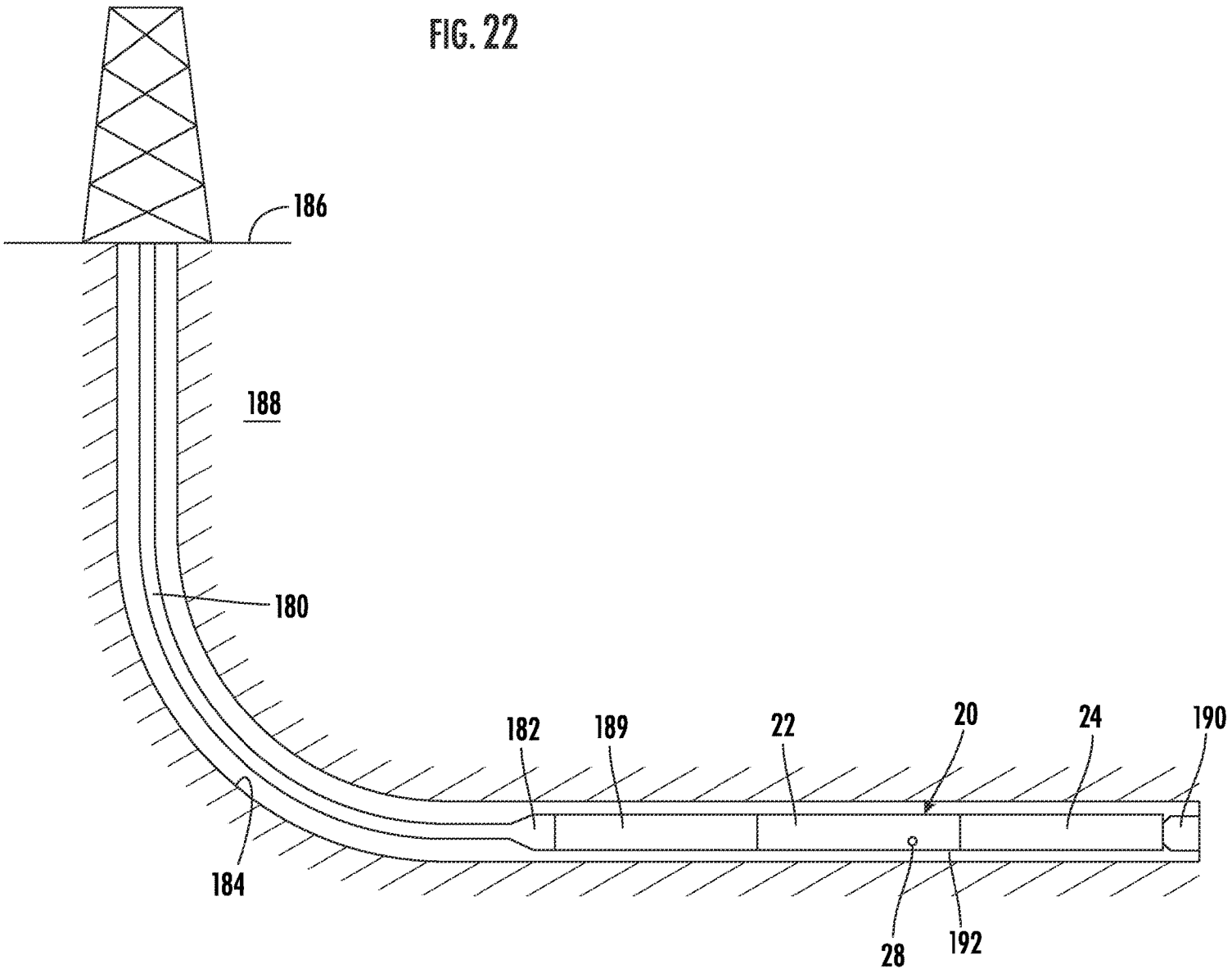
FIG. 22 is a schematic view of an embodiment of the drilling system positioned in a subterranean wellbore using a coiled tubing string.

Referring now to FIG. 22, drilling system 20 may be secured to a distal end of coiled tubing string 180 with coiled tubing connector 182 for use in drilling wellbore 184 extending below surface 186 through subterranean formation 188. In this embodiment, an MWD tool 189 may be positioned between coiled tubing connector 182 and separation device 22, with driving mechanism 24 and drill bit or mill 190 positioned downstream. A drilling media may be pumped through coiled tubing string 180 and coiled tubing connector 182. As the drilling media flows through separation device 22 in the filter mode (i.e., the default mode), all or a portion of the solid particles within the drilling media are removed and collected within separation device 22. The cleaned drilling media (i.e., the remaining liquid or gas components) flow downstream through the driving mechanism 24 and drill bit 26. In embodiments of separation device 22 that are activated in response to an automatic trigger, separation device 22 may be placed into the flush mode when the separation device 22 reaches a predefined threshold volume or amount of collected solids and the upstream fluid pressure increases by a predefined amount. In the flush mode, separation device 22 uses the flow of drilling media to flush the collected solid particles out of separation device 22 through flush outlet 28 and into annulus 192 between the drilling system 20 and the formation 188. Once the upstream fluid pressure drops below a predefined deactivation value, the separation device 22 may automatically switch back into the filter mode so that the solid particles are collected from the drilling media flowing through separation device 22 and the cleaned drilling media then flows through driving mechanism 24. The separation device 22 may also be placed in the filter mode or in the flush mode in response to a signal received from a surface of the wellbore. Such signals may be, but not limited to, a sequence of pressure pulses (mud weight changes), flow rate changes, drill pipe rotation changes or the use of RFID (Radio-frequency identification) technology.

Figure 23:
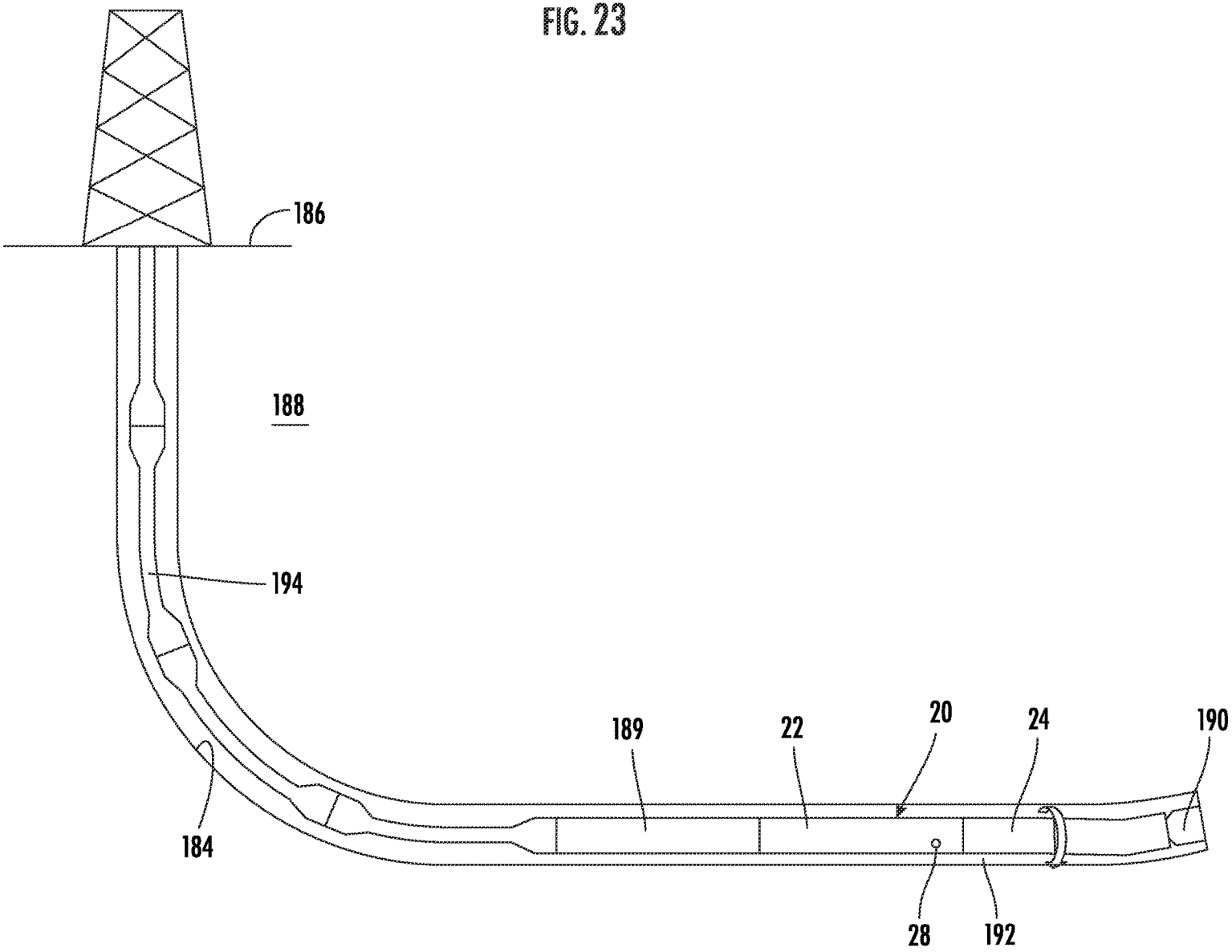
FIG. 23 is a schematic view of an embodiment of the drilling system including a bent motor positioned in a subterranean wellbore using a tubular drill string.

With reference to FIG. 23, drilling system 20 may be secured to a distal end of a drill string 194 for use in drilling wellbore 184. In this embodiment, MWD tool 189 may be positioned upstream of separation device 22, with driving mechanism 24 and drill bit 26 positioned downstream. Driving mechanism 24 may include a bent housing drilling motor. Drilling media flowing through drill string 194 may flow through separation device 22 before reaching driving mechanism 24 and drill bit 26. Separation device 22 in the filter mode may remove a portion or all of the solid particles in the drilling media. In the same way as in FIG. 22, when the collected solid particles in separation device 22 cause the upstream fluid pressure to reach a predefined activation value, separation device 22 is activated and placed in the flush mode. When activated, the fluid flowing through separation device 22 flushes the collected solids through flush outlet 28 and into annulus 192 between drilling system 20 and the formation 188. After deactivation, the fluid flowing through separation device 22 in the filter mode is again cleaned before flowing into driving mechanism 24.

Figure 24:
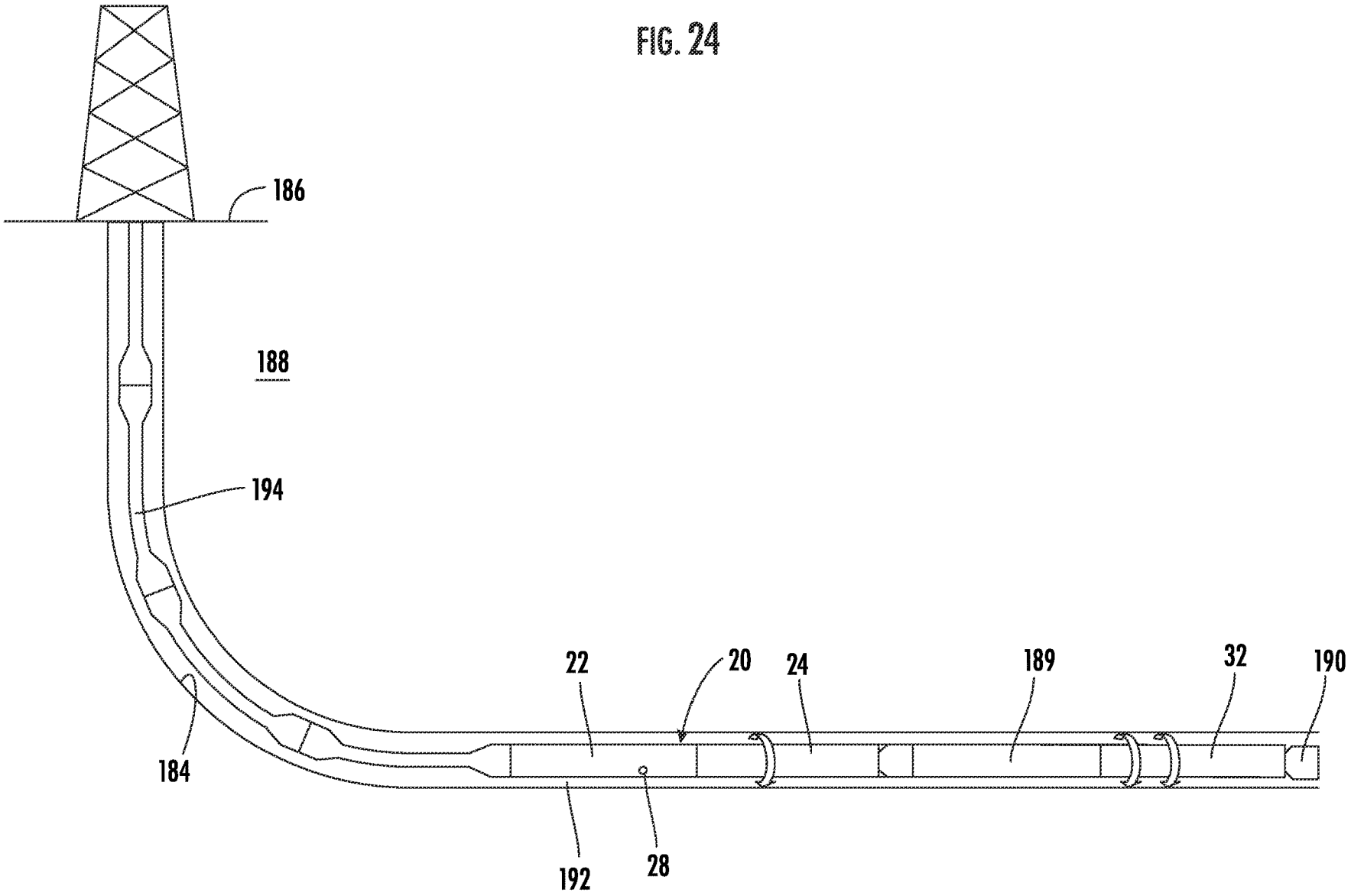
FIG. 24 is a schematic view of an embodiment of the drilling system including a rotary steerable system positioned in a subterranean wellbore using a tubular drill string.

FIG. 24 illustrates an alternate embodiment of the drilling system 20 secured to a distal end of a drill string 194 for use in drilling wellbore 184. In this embodiment, MWD tool 189 may be positioned downstream of both separation device 22 and driving mechanism 24. Drilling system 20 may include steering mechanism 32 disposed between MWD tool 189 and the drill bit 26. Steering mechanism 32 may be a rotary steerable system. In this embodiment, separation device 22 in the filter mode removes all or a portion of solid particles from the drilling media before it reaches the driving mechanism 24. Separation device 22 is activated into the flush mode when a predefined amount of solids are collected. In the flush mode, the fluid flushes the collected solids through flush outlet 28 into annulus 192 between drilling system 20 and subterranean formation 188. Then, separation device 22 is deactivated and placed in the filter mode to again remove and collect solid particles from the drilling media.

Alternatively, separation device 22 used as illustrated in FIGS. 22-24 may be activated and switched into the flush mode in response to a signal from the surface. For example, the signal may be a pressure pulse, an electric signal, a magnetic signal, a mechanical signal (rotational speed change, weight-on-bit (WOB) change, axial movement of drill pipe, etc.), or any other type of signal capable of being detected within wellbore 184.

Figure 25:
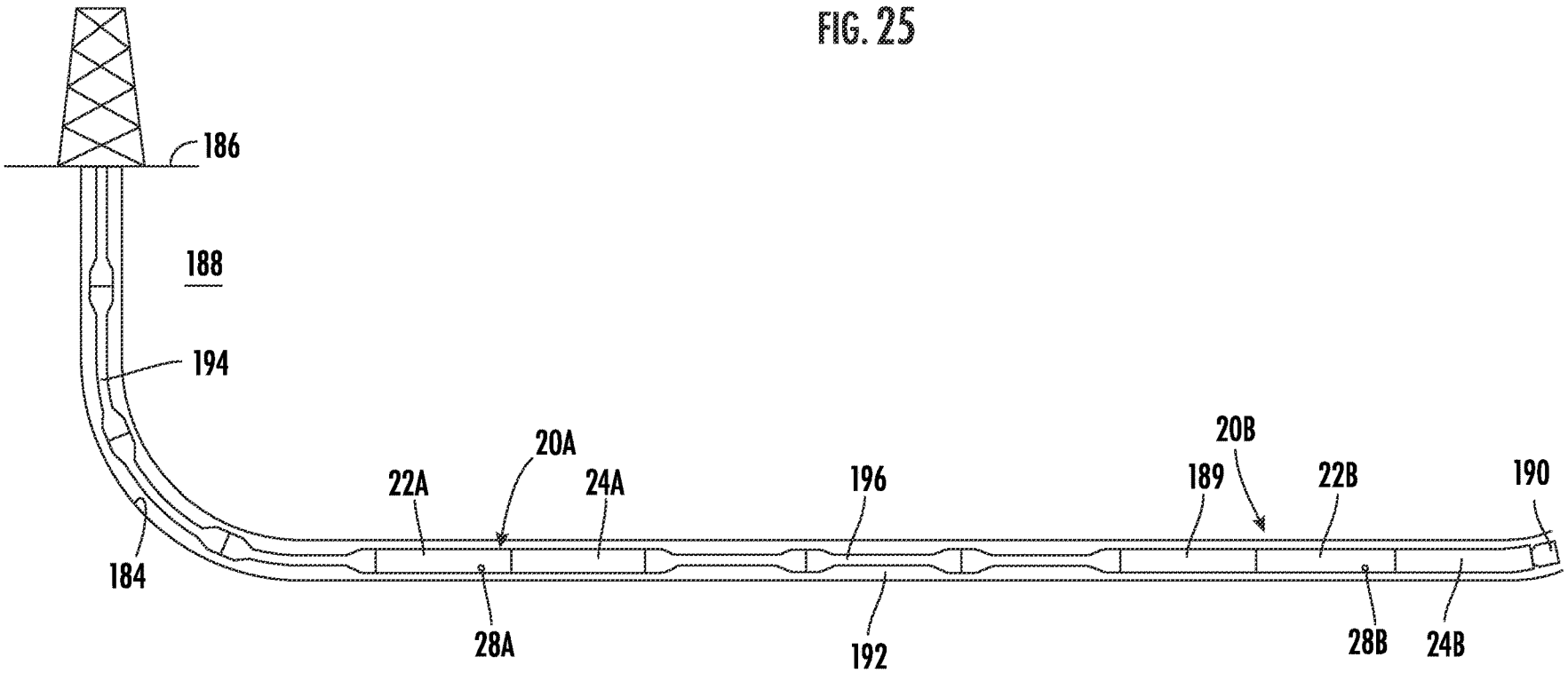
FIG. 25 is a schematic view of an embodiment of the drilling system including two separation devices and two driving mechanisms.

As shown in FIG. 25, two or more drilling systems 20 may be used in a drill string 194 when drilling wellbore 184. Upstream drilling system 20A may be secured to a downstream end of drill string 194, and tubular string 196 may be secured between upstream drilling system 20A and downstream drilling system 20B. Upstream drilling system 20A includes separation device 22A and driving mechanism 24A, and downstream drilling system 20B includes separation device 22B and driving mechanism 24B. Driving mechanism 24B may be configured to drive drill bit 190, while driving mechanism 24A may be configured to generate a vibration, activate a valve or any actuation device, or power an electrical generator. For example, driving mechanism 24B may include a positive displacement motor (e.g., a vane motor or a Moyno motor), a turbine, a percussion motor, or a hammer, while driving mechanism 24A may include a turbine, a friction reduction tool, or a vibration generating tool.

FIGS. 26-29 illustrate the interaction of the mode of downstream separation device 22B in relation to the mode of upstream separation device 22A. In the illustrated embodiment, both separation devices 22A and 22B include the same features and functions described above in connection with filter 86. In some embodiments, the separation devices 22A and 22B are configured to be independently activated from the filter mode into the flush mode in response to an automatic activation trigger (e.g., a predefined pressure drop) or in response to a signal from the surface. For example, each separation device 22A may be configured to respond to surface signal A and surface signal C, while separation device 22B may be configured to respond to surface signal B and surface signal C. In this way, surface signals can activate separation device 22A only, separation device 22B only, or both separation devices 22A and 22B. In other embodiments, the separation devices 22A and 22B are configured to be activated simultaneously in response to all the same automatic activation trigger and/or the same signal from the surface of the wellbore.

Figures 26, 27, 28, 29:
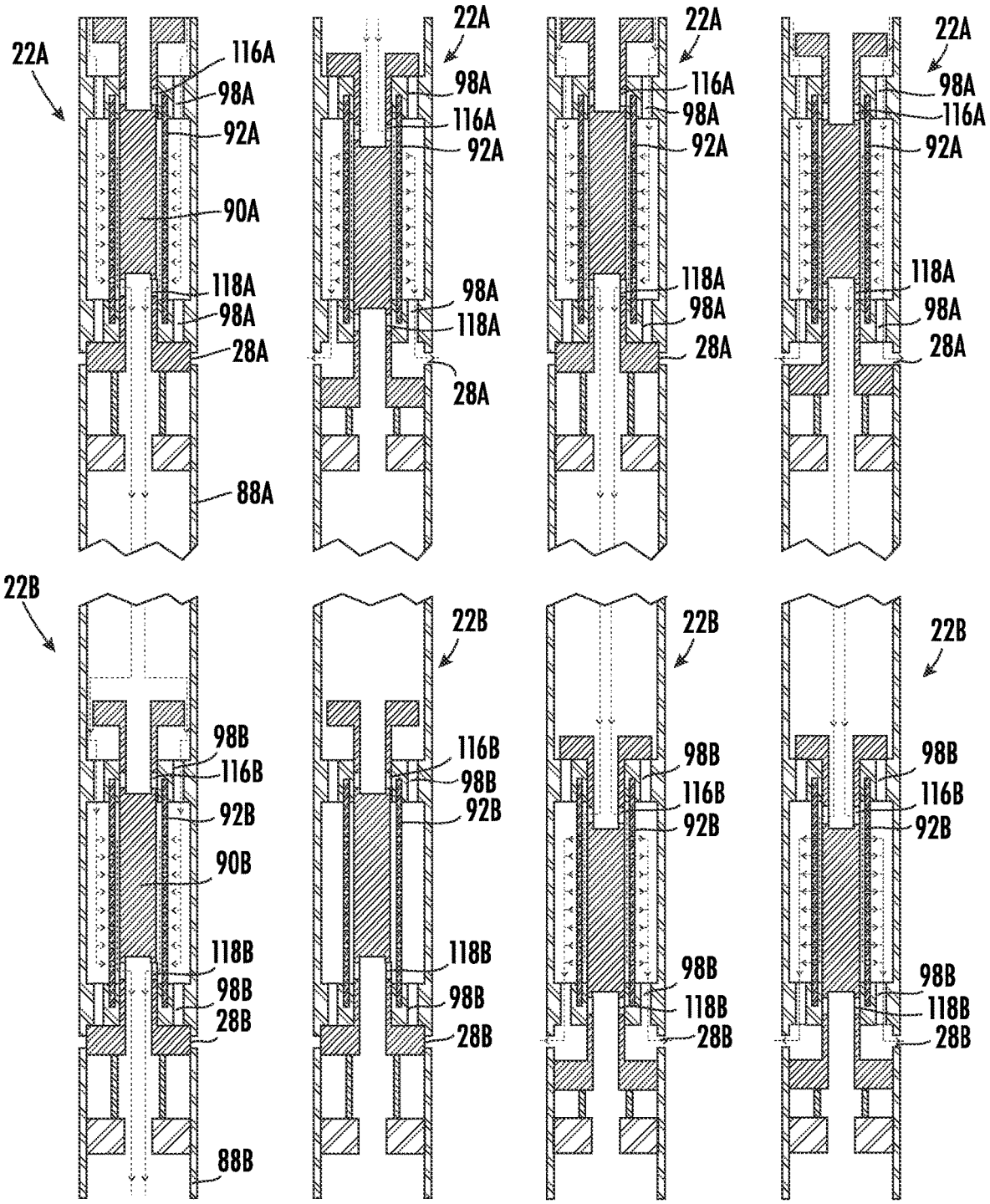
FIG. 26 is a sectional view of an upstream separation device and a downstream separation device both in the filter mode.
FIG. 27 is a sectional view of the upstream and downstream separation devices with the upstream separation device in a complete flush mode.
FIG. 28 is a sectional view of the upstream separation device in the filter mode and the downstream separation device in the flush mode.
FIG. 29 is a sectional view of the upstream separation device in a partial flush mode and the downstream separation device in the complete flush mode.

Referring now to FIGS. 25 and 26 illustrates both separation devices 22A and 22B in the filter mode. In this mode, drilling media flows through the filter flow path in upstream separation device 22A: through fluid passages 98A, through the openings in filter surfaces 92A, through lower ports 118A and to driving mechanism 24A. The portion of solids from the drilling media collected by separation device 22A are retained such that the solids content of the drilling media and the size of the solids is reduced before entering driving mechanism 24A. After flowing through driving mechanism 24A, the drilling media flows through tubular string 196 and MWD device 189, then enters downstream separation device 22B. In the illustrated filter mode, the drilling media flows through the filter flow path in downstream separation device 22B: through fluid passages 98B, through the openings in filter surfaces 92B, through lower ports 118B and to driving mechanism 24B. The portion of solids from the drilling media collected by separation device 22B are retained such that the solids content of the drilling media and the size of the solids is reduced before entering driving mechanism 24B. After flowing through driving mechanism 24B, the drilling media flows to drill bit 190.

With reference to FIGS. 25 and 27, upstream separation device 22A may be activated alone in order to flush the collected solids out of upstream separation device 22A into the annulus 192. In the illustrated complete flush mode of separation device 22A, no appreciable amount of drilling media flows to the downstream separation device 22B. Instead, substantially all of the drilling media flowing into upstream separation device 22A flows through its flush flow path: through upper ports 116A, the openings in filter surface 92A, fluid passages 98A, and exits separation device 22A through flush outlet 28A. In this mode, the drilling media flushes the collected solids out of separation device 22A and into annulus 192. No drilling media flows downstream beyond separation device 22A when it is in the complete flush mode. The mode of downstream separation device 22B has no effect on drilling media flow when upper separation device 22A is in this mode.

Referring now to FIGS. 25 and 28, downstream separation device 22B may be activated into the complete flush mode while upstream separation device 22A remains in the filter mode to flush out only downstream separation device 22B. The drilling media flowing into upstream separation device 22A flows through the filter flow path and to upstream driving mechanism 24A. After flowing through tubular string 196 and MWD 189, the drilling media flows into downstream separation device 22B. Substantially all of the drilling media flows through the flush flow path of separation device 22B: through upper ports 116B, the openings in filter surface 92B, fluid passages 98B, and exits separation device 22B through flush outlet 28B.

With reference to FIGS. 25 and 29, both separation devices 22A and 22B may be activated into a flush mode simultaneously. For example, upper separation device 22A may be placed in a partial flush mode in which a portion of the drilling media entering separation device 22A flows through its flush flow path to flush collected solids out through flush outlet 28A into the annulus 192. The remainder of the drilling media entering separation device 22A flows through its filter flow path and flows through upstream driving mechanism 24A, through tubular string 196, through MWD 189, and enters downstream separation device 22B. In the embodiment illustrated in FIG. 29, the downstream separation device 22B has been activated into a complete flush mode such that substantially all of the drilling media entering separation device 22B flows through its flush flow path and exits through the flush outlet 28B into annulus 192. Alternatively, the downstream separation device 22B may be placed in a partial flush mode while upstream separation device 22A is in the partial flush mode such that a portion of the drilling media flows to downstream driving mechanism 24B and drill bit 190.

As used herein, "driving mechanism" means any device or tool capable of converting hydraulic horsepower or pneumatic horsepower into mechanical horsepower, such as, but not limited to, mechanical horsepower for use in driving a bit or mill, powering an electrical generator, activating a valve, activating any actuation device, or generating a vibration or impact.

As used herein, "elastomer" means any material that has elastic material properties, such as but not limited to polymers that are capable of recovering their original shape after being stretched, contracted, dilated, or distorted.

As used herein, "elastomer-free" in reference to a mechanism or tool means a mechanism or tool having no components formed of any elastomer.

As used herein, "high temperature sensitive materials" means materials that degrade, break down, melt, or experience a change in at least one mechanical property to such an extent that the material becomes unusable in the drilling system, at temperatures above 320° F. or at temperatures between 320° F. and 1110° F., or any subrange therein.

As used herein, "drilling media" means any liquid or compressible gas, which may include solid particles.

Except as otherwise described or illustrated, each of the components in this device has a generally cylindrical shape and may be formed of steel, another metal, or any other durable material. Portions of drilling system 20 may be formed of a wear resistant material, such as tungsten carbide, ceramics, or ceramic coated steel.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. "Plurality" means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A drilling system for use in drilling a wellbore, comprising:

a driving device, the driving device configured to convert hydraulic or pneumatic horsepower into mechanical horsepower;

a separation device disposed upstream of the driving device and including an external housing, the external housing including a sidewall; the separation device including a filter flow path and a flush flow path;

wherein the flush flow path extends to a flush outlet on an outer surface of the separation device, the flush outlet being in direct fluid communication with a section of an annulus between the outer surface of the separation device and the wellbore, the flush outlet comprising a port extending through the sidewall of the external housing of the separation device;

wherein the separation device is configured to filter at least a portion of any solids from a drilling media flowing through the filter flow path; and wherein the separation device is configured to flush at least a portion of the filtered solids through the flush outlet and into the section of the annulus when the drilling media flows through the flush flow path.

2. The drilling system of claim 1, wherein the separation device is configured to direct the drilling media through the filter flow path in a filter mode; wherein activation of the separation device places the separation device in a flush mode; wherein the separation device is configured to direct at least a portion of the drilling media through the flush flow path and the flush outlet in the flush mode.

3. The drilling system of claim 2, wherein the separation device is activated in response to a signal from the surface of the wellbore.

4. The drilling system of claim 2, wherein the separation device is automatically activated in response to an automatic trigger.

5. The drilling system of claim 2, wherein in the flush mode the separation device prevents all of the drilling media from flowing to the driving device.

6. The drilling system of claim 2, wherein in the flush mode the separation device allows a portion of the drilling media to flow to the driving device.

7. The drilling system of claim 1, wherein the filter flow path extends from a dirty side of a filter surface to a clean side of the filter surface; and wherein the flush flow path extends from the clean side of the filter surface to the dirty side of the filter surface.

8. The drilling system of claim 1, wherein the driving device includes a positive displacement motor.

9. The drilling system of claim 8, wherein the positive displacement motor is a Moyno motor or a vane motor.

10. The drilling system of claim 1, wherein the driving device includes a turbine.

11. The drilling system of claim 1, wherein the driving device includes a hammer device or a vibration generating device.

12. The drilling system of claim 1, wherein the driving device includes a friction reduction tool.

13. The drilling system of claim 1, wherein the driving device includes a steerable drilling motor including a bent sub.

14. The drilling system of claim 1, wherein the driving device includes a rotary steerable system.

15. The drilling system of claim 1, wherein neither the driving device nor the separation device includes any high temperature sensitive materials.

16. The drilling system of claim 1, further comprising:

a second driving device, the second driving device configured to convert hydraulic or pneumatic horsepower into mechanical horsepower; and a second separation device disposed upstream of the second driving device and including an external housing, the external housing of the second separation device including a sidewall; the second separation device including a filter flow path and a flush flow path; wherein the flush flow path of the second separation device extends to a flush outlet on an outer surface of the second separation device, the flush outlet of the second separation device being in direct fluid communication with a second section of the annulus between the outer surface of the second separation device and the wellbore, the flush outlet of the second separation device comprising a port extending through the sidewall of the external housing of the second separation device;

wherein the second separation device is configured to filter at least a portion of any solids from the drilling media flowing through the filter flow path of the second separation device; and wherein the second separation device is configured to flush at least a portion of the filtered solids through the flush outlet of the second separation device and into the second section of the annulus when the drilling media flows through the flush flow path of the second separation device.

17. The drilling system of claim 16, wherein the separation device is configured to direct the drilling media through the filter flow path of the separation device in a filter mode; wherein activation of the separation device places the separation device in a flush mode; wherein the separation device is configured to direct at least a portion of the drilling media through the flush flow path of the separation device and the flush outlet of the separation device in the flush mode; and wherein the second separation device is configured to direct the drilling media through the filter flow path of the second separation device in a filter mode; wherein activation of the second separation device places the second separation device in a flush mode; wherein the second separation device is configured to direct at least a portion of the drilling media through the flush flow path of the second separation device and the flush outlet of the second separation device in the flush mode.

18. The drilling system of claim 17, wherein the separation device and the second separation device are each activated in response to one or more signals from the surface of the wellbore.

19. The drilling system of claim 17, wherein the separation device and the second separation device are each automatically activated in response to an automatic trigger.

20. The drilling system of claim 17, wherein the separation device and the second separation device are configured to be activated simultaneously or in sequence.

21. The drilling system of claim 17, wherein the separation device and the second separation device are configured to be activated independently.

22. A method of drilling a wellbore, comprising the steps of:

a) providing a drilling system comprising: a driving device and a separation device disposed upstream of the driving device and including an external housing, the external housing including a sidewall; the driving device configured to convert hydraulic or pneumatic horsepower into mechanical horsepower; the separation device including a filter flow path and a flush flow path; wherein the flush flow path extends to a flush outlet on an outer surface of the separation device, the flush outlet being in direct fluid communication with a section of an annulus between the outer surface of the separation device and the wellbore, the flush outlet of the separation device comprising a port extending through the sidewall of the external housing of the separation device;

b) drilling the wellbore in a subterranean formation with the drilling system;

c) flowing a drilling media through the filter flow path of the separation device to filter at least a portion of any solids within the drilling media; wherein any filtered solids are retained within the separation device;

d) flowing the drilling media to the driving device; and e) activating the separation device to flow the drilling media through the flush flow path of the separation device to flush at least a portion of the filtered solids through the flush flow path and through the flush outlet and into the section of the annulus.

23. The method of claim 22, wherein in step (e) the separation device is activated in response to a signal from the surface of the wellbore.

24. The method of claim 22, wherein in step (e) the separation device is automatically activated in response to an automatic trigger.

25. The method of claim 22, further comprising the step of:

f) deactivating the separation device to flow the drilling fluid through the filter flow path; wherein steps (b) through (e) are conducted without removing the separation device from the wellbore.

26. The method of claim 22, wherein neither the driving device nor the separation device includes any high temperature sensitive materials.

27. The method of claim 22, wherein in step (a) the drilling system further includes: a second driving device and a second separation device disposed upstream of the second driving device and including an external housing, the external housing of the second separation device including a sidewall; the second driving device configured to convert hydraulic or pneumatic horsepower into mechanical horsepower; the second separation device including a filter flow path and a flush flow path; wherein the flush flow path of the second separation device extends to a flush outlet on an outer surface of the second separation device, the flush outlet of the second separation device being in direct fluid communication with a second section of the annulus between the outer surface of the second separation device and the wellbore, the flush outlet of the second separation device comprising a port extending through the sidewall of the external housing of the second separation device; wherein the second driving device and the second separation device are disposed downstream of the driving device; the method further comprising the steps of:

f) flowing the drilling media through the filter flow path of the second separation device to filter at least a portion of any solids within the drilling media; wherein any filtered solids are retained within the second separation device;

g) flowing the drilling media to the second driving device; and h) activating the second separation device to flow the drilling media through the flush flow path of the second separation device to flush at least a portion of the filtered solids through the flush flow path of the second separation device and through the flush outlet of the second separation device and into the second section of the annulus.

28. The method of claim 27, wherein step (e) and step (h) occur simultaneously or in sequence.

29. The method of claim 27, wherein step (e) and step (h) occur independently.

* * * * *